US007272861B2

(12) United States Patent
Colletti et al.

(10) Patent No.: US 7,272,861 B2
(45) Date of Patent: Sep. 25, 2007

(54) FACE-MASK NECK SASH

(75) Inventors: Frank Colletti, Amityville, NY (US); Charles Rauth, Matawan, NJ (US)

(73) Assignee: Exo-Pro, Inc., Amityville, NY (US)

( * ) Notice: Subject to any disclaimer, the term of this patent is extended or adjusted under 35 U.S.C. 154(b) by 32 days.

(21) Appl. No.: 10/760,816

(22) Filed: Jan. 20, 2004

(65) Prior Publication Data

US 2005/0155136 A1 Jul. 21, 2005

(51) Int. Cl.
*A42B 1/18* (2006.01)

(52) U.S. Cl. ..... 2/206; 2/468; 2/173; 2/918

(58) Field of Classification Search ..... 2/916, 2/468.173, 207, 175.6, 918, 26
See application file for complete search history.

(56) References Cited

U.S. PATENT DOCUMENTS 891,122 A * 6/1908 Wilcox ..... 2/206
1,200,528 A * 10/1916 Ryder ..... 2/203
4,300,240 A 11/1981 Edwards
4,825,474 A 5/1989 Edwards
5,214,804 A 6/1993 Carey
6,272,690 B1 8/2001 Carey
2004/0098789 A1* 5/2004 Carey ..... 2/173

OTHER PUBLICATIONS

Joseph-Armstrong, Helen. "Patternmaking for Fashion Design" Third Edition, pp. 20 and 120-123, Prentice Hall, 2000.*

* cited by examiner

*Primary Examiner*—Katherine Moran
*Assistant Examiner*—Richale L. Haney
(74) *Attorney, Agent, or Firm*—David J. DeToffol, Esq P.C.; David J. DeToffol

(57) ABSTRACT

A method to manufacture a neck sash of elastic insulating material unitarily formed with a face-mask so as to contour and comfortably shelter the user's throat and upper sternum area against adverse weather conditions.

1 Claim, 2 Drawing Sheets

FACE-MASK NECK SASH

BACKGROUND

1. Field of the Invention

This invention relates to apparel. In particular this invention relates to a neck sash that comfortably shelters and insulates the user's throat and upper sternum from harsh atmospheric weather conditions, such as cold weather, wind, rushing air, airborne particulates, rain and water.

2. State of the Art

A variety of headgear is known to insulate a user's face from inclement weather. For example, U.S. Pat. No. 6,272,690 B1 (Carey) discloses a scarf portion completely encircling a user's neck, extending down to and surrounding the entire collar, and covering portions of the anterior and posterior shoulder areas. The scarf is integrally formed with a head member as an article of clothing, and the head member may either substantially or completely cover the user's head.

The user's head is placed through an opening in the article, and the article is pulled down into position. Although the scarf member may readily detach from the head member, the head member is not readily detachable from the user's head.

U.S. Pat. No. 4,825,474 (Edwards) discloses a readily detachable cold weather face-mask covering down to the area of the chin and neck juncture, and a method to make the mask. To more clearly illustrate a curvature aspect to the mask its drawings show the mask's neck portion lower than what is claimed, yet not low enough to cover the throat. And '474 has a spacer piece in both the apparatus and method claims that is cut separately from the mask member, and used to span across the chin area at the chin's juncture with the neck.

In sum, the sheltering facial wear heretofore known provides insulation and protection of neck against cold weather and wind, but has not achieved the objects of the present invention. '474 discloses a short neck portion that is fashioned with a separately integrated spacer piece; and '690 B1 discloses and claims a cumbersome face-mask and scarf that encircles the entire neck.

And finally, this application's inventors filed an earlier patent application for an insulating face-mask on Sep. 30, 2003 under Ser. No. 10/674,597. That invention extends only as far down as the user's gullet. Reference is made to that application's disclosure for the best mode face-mask being contiguously and seamlessly joined to the neck sash invention disclosed and claimed in the instant application.

SUMMARY OF THE INVENTION

The instant invention relates to a neck sash for a face-mask, where the sash comfortably shelters and insulates the throat and upper sternum from typical and common adverse atmospheric weather conditions. The neck sash and the face-mask are contiguous and unitarily formed from the same elastic and insulating textile material.

The neck sash has a neckpiece member sized and shaped to fit closely about the user's throat and upper sternum areas, and the face-mask is sized and shaped to fit snugly about the head of a user.

In a preferred embodiment the neck sash has a neckpiece member having a top perimeter proximate and contoured along the intersection formed between the neck and the underside of the jaw. In this arrangement the neckpiece's top perimeter seamlessly joins with a bottom perimeter of the snugly fitting face-mask.

This neckpiece top perimeter extends in width from about the rear of the left ear to about the rear of the right ear. And below, proximate and co-linear with the clavicle bones, is a bottom perimeter extending in width to approximately match the breadth of the upper sternum. The bottom perimeter of the neckpiece defines the lowest horizontal peripheral edge of the neck sash.

The neck sash also has left and right vertical peripheral edges. Defining the left peripheral edge is a left edge to the neckpiece, extending in a substantially direct path leading between the distal ends of the neckpiece's top and bottom perimeter on the left side of the face.

The neck sash right peripheral edge is similarly defined, however by a right edge of the neckpiece extending in a substantially direct path leading between the distal ends of the neckpiece's top and bottom perimeter on the right side of the face.

A method of fabricating the face-mask neck sash requires a supply of flat sheet insulating and elastic textile material.

In succeeding steps, the sheet is positioned in a two-dimensional flat plane, and at least one cutting means is used to cut the sheet to form seam edges, peripheral edges and apertures of the face-mask's members, and seam edges and peripheral edges of the neck sash's members. The cuts form a substantially symmetrical flat filet, designed to be subsequently joined along the seam edges to form a three-dimensional contoured face-mask and neck sash structure.

The two-dimensional features of the filet's neck sash portion are sized and shaped in a left neckpiece half and a right neckpiece half, each having peripheral and seam edges. The shape of the flat halves are designed such that when co-joined and secured along their seam edges, the halves form a three-dimensional neck sash contoured to fit closely about the throat and upper sternum areas of a user.

In three-dimensional structural terms, the neck sash has a top perimeter, a bottom peripheral edge, and left and right peripheral edges as described for the neck sash preferred embodiment described above.

In further steps, the flat filet is manipulated away from the remaining portions of the sheet, and the seam edges of the neckpiece halves are joined along their corresponding seam edges. In a final step securing means are utilized to secure the neckpiece member halves along their co-joined seam edges. The neckpiece co-joining and securing steps may be performed respectively with the face mask members' co-joining and securing operations.

BRIEF DESCRIPTION OF THE DRAWINGS

The drawings illustrate the best modes presently contemplated for carrying out the invention.

DETAILED DESCRIPTION OF THE INVENTION

Figure 1:
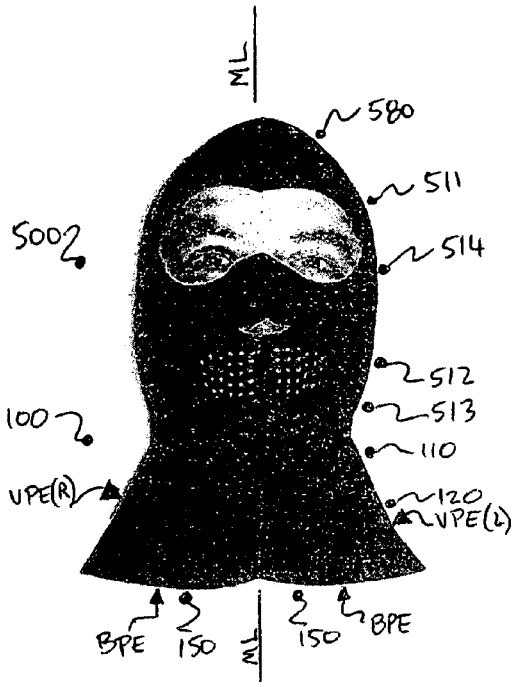
FIG. 1 is a front view of a face-mask neck sash of the instant invention positioned on a user.

Referring to the drawings in FIGS. 1-4, the preferred embodiment of the face-mask neck sash appears mounted to a user. The neck sash is generally depicted in FIG. 1 by the number 100, and the face-mask by number 500. When worn, the face-mask 500 fits snugly about the areas of the user's forehead 511, face 512, gullet 513, ears 514 and crown 580, and the neck sash 100 fits closely over the areas of the user's throat 110 and upper sternum 120. The neck sash 100 has a neckpiece member 150.

The face-mask and neck sash is formed of an elastic and insulating textile material. The best mode for practicing the instant invention utilizes neoprene, a stock rubber based composite layered on one or both sides with synthetic fabric. Thicker or thinner stock materials can be used to respectively increase or decrease the insulating factor. For example, an appropriate thinner non-composite material such as spandex can be used.

Various fabric laminates on the interior and exterior of the material may be used to accommodate comfort factors.

Various colors, patterns, graphics and designs, particularly on the exterior surface, may be utilized to enhance or adapt the mask and sash to surrounding environmental conditions such as to create the effect of visual contrast or camouflage to the environs, or to absorb or reflect external radiant heat, or to display fanciful graphics for sport use or team identity.

Figure 3:
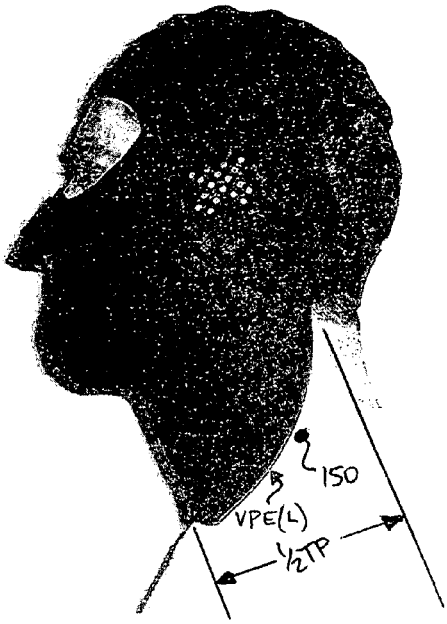
FIG. 3 is a left side view of the insulating face-mask in FIG. 1 positioned on a user.
Figure 4:
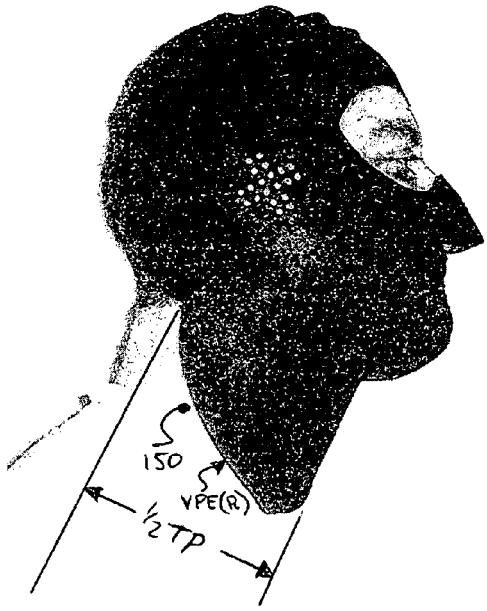
FIG. 4 is a right side view of the of the insulating mask shown in FIG. 1.

As shown in FIGS. 1, 3 and 4, the neckpiece member 150 canvasses close to the user's upper sternum, and front and mid-sides of the neck.

Figure 2:
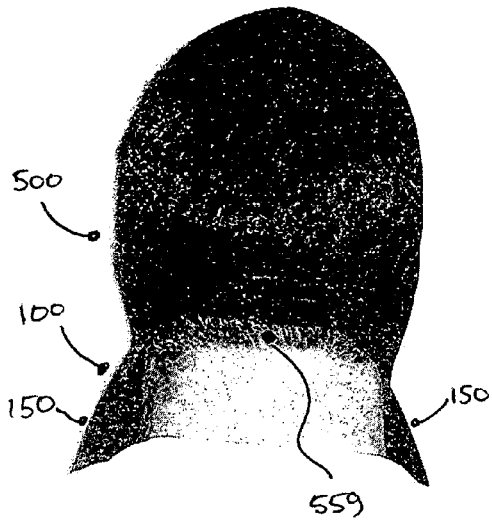
FIG. 2 is a rear view of the insulating face-mask in FIG. 1 positioned on a user.

FIG. 2 illustrates a co-acting and removable fastening means 559 of the face-mask 500 that allows for the neck sash 100 to be readily removed along with the face-mask 500. Also illustrated is that the neckpiece member 150 blankets beyond the neck's width, yet does not surround the rearward or back of the user's neck. The neck sash's 100 open feature at the rearward and back of the user's neck does not interfere with users' long hairstyles, nor interfere with the posterior collar aspect of users' jacket outerwear.

In FIG. 1 a bottom peripheral edge BPE of the neckpiece 150 is shown in the best mode, running approximately along the horizontal line of the clavicle bones and defines the lowest horizontal peripheral edge of the neck sash. The bottom peripheral edge BPE extends in width to approximately match the breadth of the upper sternum.

As shown in FIGS. 1, 3 and 4, the neck sash 100 seamlessly joins the face-mask 500 along a top perimeter TP of the neckpiece 150. In the best mode, the top perimeter TP extends in width from about the rear of the left ear to about the rear of the right ear, running proximate and contoured along the intersection formed between the neck and the underside of the jaw. One-half of the top perimeter is depicted in FIG. 3 as ½TP(L), and the other half to the top perimeter is depicted in FIG. 4 as ½TP(R). Together ½TP (L) and ½TP(R) form the entire perimeter TP.

What is more, is that the top perimeter TP arrangement between the neck sash 100 and snugly fitting face-mask 500 supports and urges the neckpiece 150 to closely and comfortably fit, shelter and insulate the throat and upper sternum area. An efficiency of this design is that no additional material is needed to support the neck sash 100, particularly in the open area feature shown in FIG. 2 at the rearward and back of the user's neck where unneeded material would bind and restrict the head movement during dynamic activity.

The neckpiece 150 also has a left side vertical peripheral edge VPE(L) and a right side vertical peripheral edge VPE(R), where shown in FIGS. 1, 3 and 4. Respectively, these peripheral edges extend in a substantially direct path leading between the top perimeter TP and bottom peripheral edge BPE distal ends on the left and right side of the neckpiece 150.

A preferred method to fabricate the aforementioned face-mask neck sash requires the step of supplying a sheet of an insulating and elastic textile material such as that described above—neoprene, spandex or the like. The sheet is positioned in a two-dimensional flat plane and at least one cutting means is supplied and used to cut the flat sheet to form a neckpiece right half 150(R) and left half 150(L) having seam edges SE(R) and SE(L) and peripheral edges BPE(R), VPE(R), BPE(L), and VPE(L) in a two-dimensional and substantially symmetrical flat filet, as depicted in FIG. 5.

The two-dimensional filet must be pre-planned in design so that when joined along the seam edges SE(R) and SE(L), the filet forms the aforementioned three-dimensional neck sash 100. For instance, the filet of FIG. 5 is the two-dimensional design of the face-mask and neck sash shown in three-dimension in FIGS. 1-4.

The method also requires the step of manipulating the cut two-dimensional filet away from the remaining portions of the sheet, and joining the respective seam edges of the filet to form a three-dimensional contoured face-mask and neck sash. Further, the method requires supplying at least one securing means and adapting same to secure the joined seam edges. The preferred way to achieve the securing step is to sew thread by machine into the face-mask and neck sash textile material appropriately along the joined seam edges to permanently adjoin the seams edges. Glue and heat seals are alternate means to secure the edges.

Figure 5:
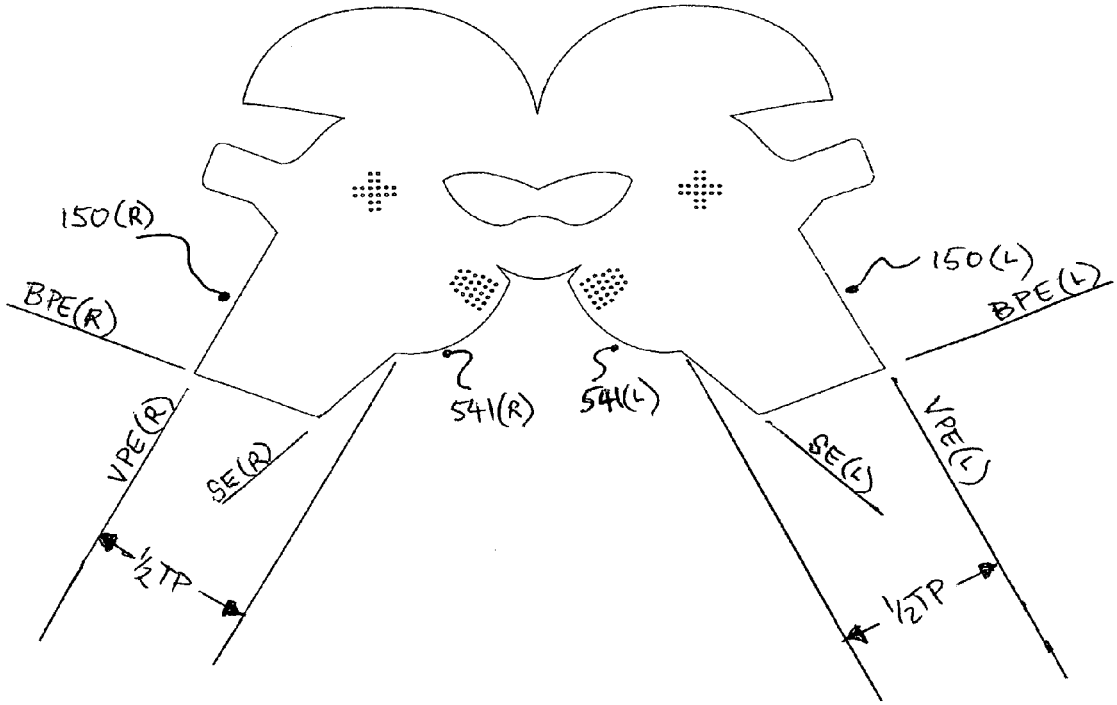
FIG. 5 is a front view of the 2-dimensional flat filet design for the 3-dimensional face-mask and neck sash shown in FIGS. 1-4.

Another particular advantage of the neck sash 100 is more clearly shown in FIG. 5 That is, to secure the neckpieces 150(R) and 150(L), only one sewn stitch line is required along the seam edges SE(R) and SE(L). Moreover, these seam edges may be secured by one continuous stitch line that includes the face-mask seam edges shown as 541(R) and 541(L).

The need for only one sewn-stitching serves the multiple purposes of being an economical aspect of manufacture; minimizing the amount of ergonomically irritating ridges to produce greater comfort during use; and providing an aesthetically pleasing feature along the lower part of the mid-line M-L in the finished product (FIG. 1).

The description of the above-illustrated embodiments is not intended to limit the scope of the claims, which themselves are regarded as essential to the invention.

What is claimed is:

1. A method of fabricating a face-mask neck sash comprising the steps of:

Supplying a sheet of insulating and elastic textile material;

Positioning said sheet in a two-dimensional flat plane;

Supplying at least one cutting means and using the same to cut said flat sheet to form a two-dimensional flat filet for a face-mask also having a set of symmetrical peripheral edges and seam edges that substantially define a left neckpiece member half and a right neckpiece member half, where the filet is designed to be subsequently co-joined along the symmetrical seam edges to form a three-dimensional contoured face-mask structure having a neck sash sized and shaped to fit closely about the throat and upper sternum areas of a user, said neck sash having in three-dimensional structure terms, a top perimeter proximate and contoured along the intersection formed between the neck and the underside of the jaw, extending in width from about the rear of the left ear to about the rear of the right ear, and a bottom peripheral edge proximate and co-linear with the clavicle bones, extending in width to span the upper sternum area, and a left vertical peripheral edge extending in a substantially direct path leading between the distal ends of the top and bottom perimeter on the left side of the face, and a right vertical peripheral edge extending in a substantially direct path leading between the distal ends of the top and bottom perimeter on the right side of the face, and wherein said top perimeter seamlessly joins along a bottom perimeter of a face member to a snugly fitting face-mask, and Manipulating said cut two-dimensional filet away from the remaining portions of the sheet;

Co-joining the left and right neckpiece member halves of the filet along the symmetry of the halves' seam edges to form of a three-dimensional contoured neck sash, and co-joining the appropriate seams edges of the face-mask; and Supplying and adapting a securing means to secure the left and right neckpiece member halves together along their co-joined seam edges, and to secure the co-joined seam edges of the face-mask.

* * * * *